US010967885B2

(12) United States Patent
Kondyra

(10) Patent No.: US 10,967,885 B2
(45) Date of Patent: Apr. 6, 2021

(54) DINING CAR WHICH MAY BE MODULATED, IN PARTICULAR FOR A RAILWAY VEHICLE

(71) Applicant: ALSTOM Transport Technologies, Saint-Ouen (FR)

(72) Inventor: Emmanuel Kondyra, La Rochelle (FR)

(73) Assignee: ALSTOM TRANSPORT TECHNOLOGIES, Saint-Ouen (FR)

( * ) Notice: Subject to any disclaimer, the term of this patent is extended or adjusted under 35 U.S.C. 154(b) by 163 days.

(21) Appl. No.: 15/700,828

(22) Filed: Sep. 11, 2017

(65) Prior Publication Data

US 2018/0072330 A1 Mar. 15, 2018

(30) Foreign Application Priority Data

Sep. 13, 2016 (FR) ..... 16 58512

(51) Int. Cl.

| | |
|---|---|
| ***B61D 1/06*** | (2006.01) |
| ***B61D 17/04*** | (2006.01) |
| ***B61D 17/10*** | (2006.01) |
| *B61D 27/00* | (2006.01) |

(52) U.S. Cl.

CPC ..... *B61D 1/06* (2013.01); *B61D 17/043* (2013.01); *B61D 17/046* (2013.01); *B61D 17/10* (2013.01); *B61D 27/0081* (2013.01)

(58) Field of Classification Search

CPC .. B61D 17/10; B61D 17/046; B61D 17/0081; B61D 17/043; B61D 1/06

See application file for complete search history.

(56) References Cited

U.S. PATENT DOCUMENTS

| | | | | |
|---|---|---|---|---|
| 2,434,841 A * | 1/1948 | Dittrich | B61D 37/006 105/327 |
| 2,633,090 A * | 3/1953 | Murphy | B61D 1/06 105/340 |
| 2,636,453 A * | 4/1953 | Dean | B61D 1/06 105/340 |
| 2,636,454 A * | 4/1953 | Clary | B61D 1/06 105/340 |
| 2,946,295 A | 7/1960 | Dean | |
| 5,063,859 A * | 11/1991 | Rader | B61D 1/06 105/340 |
| 6,945,176 B2 | 9/2005 | Säntti et al. | |

(Continued)

FOREIGN PATENT DOCUMENTS

| | | | |
|---|---|---|---|
| DE | 102006042070 | 3/2008 | |
| EP | 0625457 A1 * | 11/1994 | B61D 1/06 |

(Continued)

OTHER PUBLICATIONS

Preliminary Search Report for FR 1658512, dated May 26, 2007.

*Primary Examiner* — Scott A Browne

(74) *Attorney, Agent, or Firm* — B. Aaron Schulman, Esq.; Stites & Harbison, PLLC

(57) ABSTRACT

The dining car (10) includes first and second side structures laid out facing each other, and a first lower floor (16), the dining car comprising a first consumption area (Z1), a second preparation area (Z2), and a third technical area (Z3). The first side face includes first supporting portions intended to support a second upper floor (20), and the first (Z1), second (Z2) and third (Z3) areas are all made on the first lower floor (16).

9 Claims, 2 Drawing Sheets

(56) References Cited

U.S. PATENT DOCUMENTS

| | | | | |
|---|---|---|---|---|
| 2003/0094116 | A1 | 5/2003 | Säntti et al. | |
| 2015/0137500 | A1 * | 5/2015 | Harley | B60K 15/063 280/834 |

FOREIGN PATENT DOCUMENTS

| | | | | |
|---|---|---|---|---|
| EP | 0905000 | | 3/1999 | |
| EP | 0905000 | A1 * | 3/1999 | B61D 1/06 |
| EP | 2409889 | | 1/2012 | |
| FR | 1147988 | | 12/1957 | |
| FR | 2630698 | | 11/1989 | |
| FR | 2635064 | | 2/1990 | |
| FR | 2846291 | | 4/2004 | |
| GB | 644158 | | 10/1950 | |
| JP | 2014065439 | | 4/2014 | |
| RU | 2296685 | | 4/2007 | |
| RU | 2408484 | | 1/2011 | |

* cited by examiner

DINING CAR WHICH MAY BE MODULATED, IN PARTICULAR FOR A RAILWAY VEHICLE

The present invention relates to a dining car for a railway vehicle.

In the state of the art is already known a dining car for a railway vehicle, comprising a first consumption area, a second preparation area, and a third technical area.

The first area, a so called consumption area, is an area in which passengers are placed for eating. This first area generally includes tables and/or seats, perch-type seats, garbage bins, etc.

The second area, a so called preparation area, is a service area in which onboard personnel prepare meals (preparation, re-heating and/or cooking of food and/or of beverages). Usually, the preparation area also includes a counter at which are ordered and/or sold the beverages.

The third area, a so called technical area, includes all the technical equipment required for proper operation of the dining car, for example a cooling unit for preserving beverages, an electric supply unit, etc.

In the case of a carriage with two levels, comprising a lower level and an upper level, the first consumption area and the second preparation area are laid out on a same level, generally on the upper level, and the third technical area is laid out at another level, generally at the lower level.

The present invention notably has the object of enhancing such a dining car, by allowing great flexibility in the layout of this dining car.

For this purpose, the object of the invention is notably a dining car for a railway vehicle, including first and second side faces laid out facing each other, and a first lower floor, the dining car comprising a first consumption area, a second preparation area, and a third technical area, characterized in that:

the first side face includes first supporting portions intended to support a second upper floor, and the first, second and third areas are all laid out on the first lower floor.

The dining car according to the invention is initially provided so as to be a carriage with two levels, since it includes at least one supporting portion for a second upper floor.

The invention provides the laying out of the first, second and third areas at the lower level, thereby freeing the upper level for a use desired by the operators of the railway vehicle.

For example, the upper level may receive a fourth consumption area, a room of conventional passengers, a meeting room, leisure areas with sofas, commercial areas or any other desired area.

Advantageously, the lower level only includes pieces of equipment related to eating, any equipment not related to eating being laid out in other areas of the train.

Moreover, pieces of equipment will be selected for the third technical area for which the compactness is maximum.

Moreover, the invention gives the possibility of using diverse types of a second upper floor, for example an upper floor which does not extend over the whole length and/or which does not extend over the whole width of the carriage, in order to obtain a mezzanine effect.

Alternatively, the upper floor may be entirely suppressed, in order to form a single room with the lower level.

A dining car according to the invention may further include one or several of the following features, taken alone or according to all the technically conceivable combinations.

The dining car including a second upper floor, borne by the first supporting portions.

A fourth consumption area is made on the second upper floor.

The dining car includes means for attachment of the second upper floor with the first supporting portions, these attachment means being removable, and for example forming attachment means by bolting.

The second upper floor extends transversely between a first side edge, assembled with each first supporting portion, and a second side edge, the second side edge being spaced apart from the second side face with a non-zero distance, so as to delimit a transverse aperture between this second side edge and this second side face.

The dining car includes at least one vertical upright, extending between the first lower floor and the second upper floor, in order to support this second upper floor.

The second side face includes second supporting portions, the dining car including horizontal cross-pieces, each connecting the second upper floor to the respective one of the second supporting portions.

The second upper floor is formed with a plurality of panels, for which at least one is assembled with at least one respective one of the first supporting portions.

The second upper floor is made in a composite material.

The invention also relates to a railway vehicle including at least one dining car as defined earlier.

The invention will be better understood upon reading the description which follows, only given as an example and made with reference to the appended figures, wherein.

Figure 1:
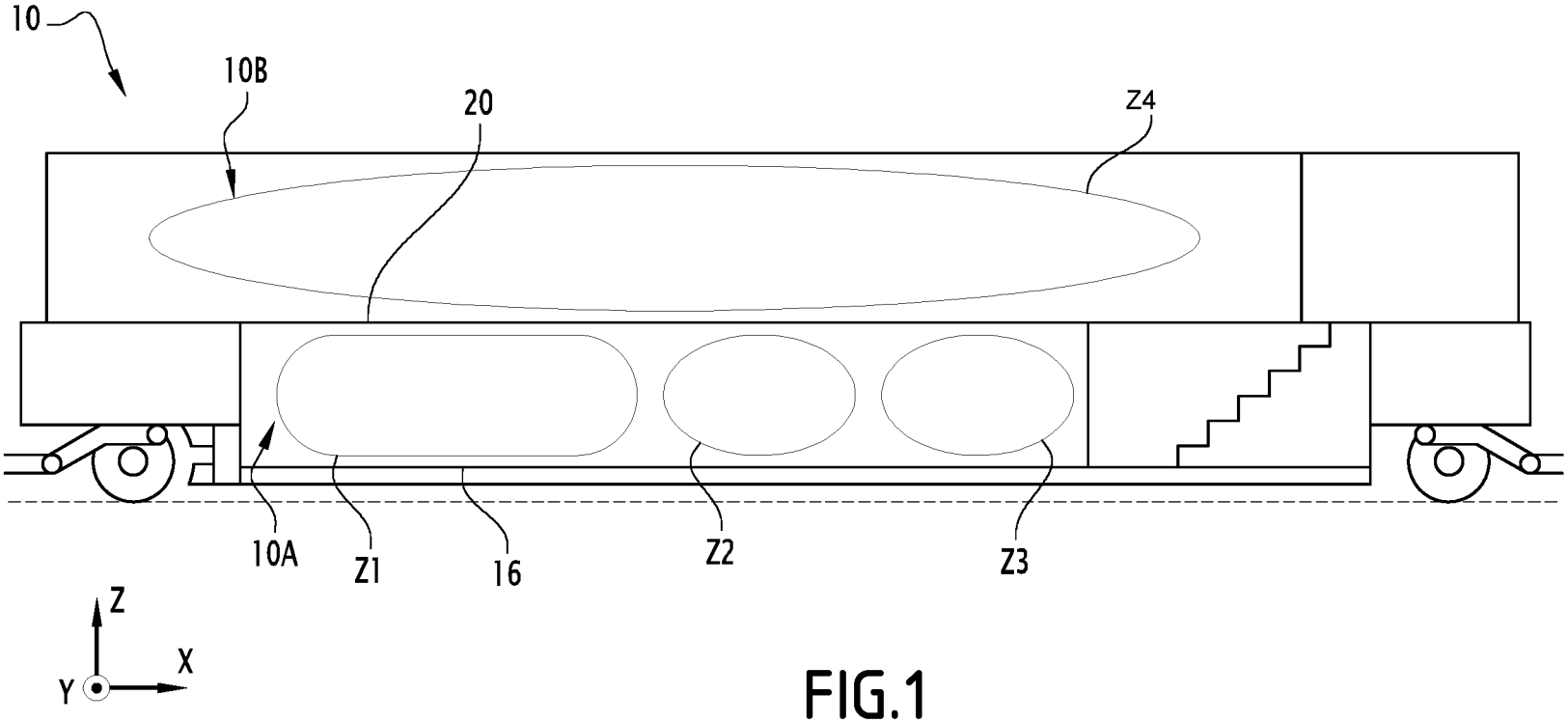
FIG. 1 is a schematic longitudinal sectional view of a dining car according to a first exemplary embodiment of the invention.
Figure 2:
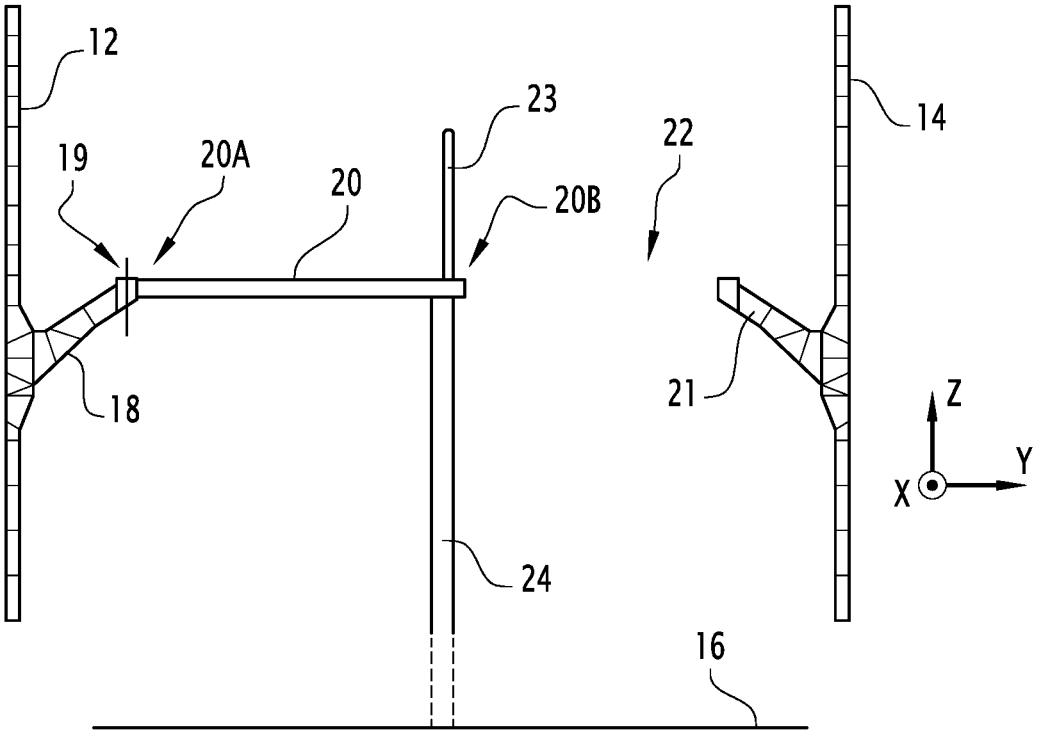
FIG. 2 is a schematic cross-sectional view of the dining car of FIG. 1.

A dining car 10 according to a first exemplary embodiment of the invention is illustrated in FIGS. 1 and 2, intended for fitting out a railway vehicle, notably a main line railway vehicle.

The dining car 10 extends in length in a longitudinal direction X.

As this is illustrated in FIG. 2, the dining car 10 includes first 12 and second 14 side faces laid out facing each other in a transverse direction Y perpendicular to the longitudinal direction X. These first 12 and second 14 side faces delimit an inner space in the transverse direction Y.

Each of the first 12 and second 14 side faces is for example respectively formed with first and second structural uprights covered with a trim. Such side faces are standard, and will not be described here in more detail. They are partly open so as to allow the availability of windows.

The dining car 10 moreover includes a first lower floor 16, delimiting the inner space downwards, in a vertical direction Z perpendicular to the longitudinal X and transverse Y directions.

This first lower floor 16 defines a lower level 10A of the dining car 10.

The first side face 12 includes at least one first supporting portion 18 (called «edge») intended to support a second upper floor 20. Each first supporting portion 18 is for example formed with an arm extending and protruding from the first side face 12 towards the inner space.

The second upper floor 20 is attached to each first supporting portion 18, by removable attachment means 19, for example attachment means by bolting. These removable attachment means 19 notably allow a replacement of the second upper floor 20.

The second upper floor 20 defines an upper level 10B of the dining car 10.

The second upper floor 20 is for example made in a composite material. Advantageously, this upper floor made removable, may be trimmed «before bolting» with a floor cladding on one side and a sealing cladding on the other side. This is notably possible because this second upper floor 20 is not assembled by welding to the first supporting portions 18.

Advantageously, the second side face 14 includes at least one second supporting portion 21, each laid out at right angles from each other from among at least one first supporting portion 18. Each second supporting portion 21 is for example formed with an arm extending and protruding from the second side face 14 towards the inner space.

According to this first embodiment, each second supporting portion 21 is not used.

However, according to other embodiments, each second supporting portion 21 forms a support for the second upper floor 20. For example, in an embodiment not described, the second upper floor 20 extends in width between a first side edge secured to the first supporting portions 18, and a second side edge secured to the second supporting portions 21. In this case, the second upper floor 20 is attached to each second supporting portion 21, by removable attachment means, for example attachment means by bolting.

According to another embodiment not shown, the dining car 10 does not include any second upper floor 20, so that the first 18 and second 21 supporting portions are all unused.

The dining car 10 includes a first consumption area Z1, a second preparation area Z2, and a third technical area Z3.

According to the invention, the first Z1, second Z2 and third Z3 areas are all made on the first lower floor 16.

For this purpose, the second preparation area Z2 and/or the third technical area Z3 are configured so as to be as compact as possible.

Thus, the upper level 10B is free of any preparation area and of any technical area. This upper level 10B is then available so as to be laid out as desired.

For example, a fourth consumption area Z4 is laid out on the second upper floor 20. Alternatively, the second upper floor 20 receives at least one conventional room of passengers, at least a meeting room, or any combination of consumption areas, passenger room, meeting room or other room.

According to the first described embodiment, the second upper floor 20 extends transversely between a first side edge 20A, assembled with each first supporting portion 18, and a second side edge 20B, the second side edge 20B being spaced apart from the second side face 14 by a non-zero distance, so as to delimit a transverse aperture 22 between this second side edge 20B and this second side face 14. Thus, the second upper floor 20 forms a mezzanine extending above the first lower floor 16.

When the second upper floor 20 forms a mezzanine, it is equipped with a guardrail 23 extending vertically, along the second side edge 20B.

This second upper floor 20 may receive a fourth consumption area Z4, at least a conventional room of passengers, at least one meeting room, or other room, in the same way as described earlier.

In order to support the second upper floor 20, the dining car 10 includes at least one vertical upright 24, extending between the first lower floor 16 and the second upper floor 20. Each vertical upright 24 is for example attached to a chassis (not shown) of the carriage 10.

Advantageously, the second upper floor 20 is formed with a plurality of panels. In this case, each panel is assembled with at least one respective one of the first supporting portions 18, and/or with at least one of the adjacent panels.

The panels extend together for example over the whole length of the carriage 10, or only alternatively on a portion of the carriage 10, in a continuous way or as a discontinuous alternative.

It will be noted that each panel has dimensions allowing its passage through a window or a door of the dining car 10.

Figure 3:
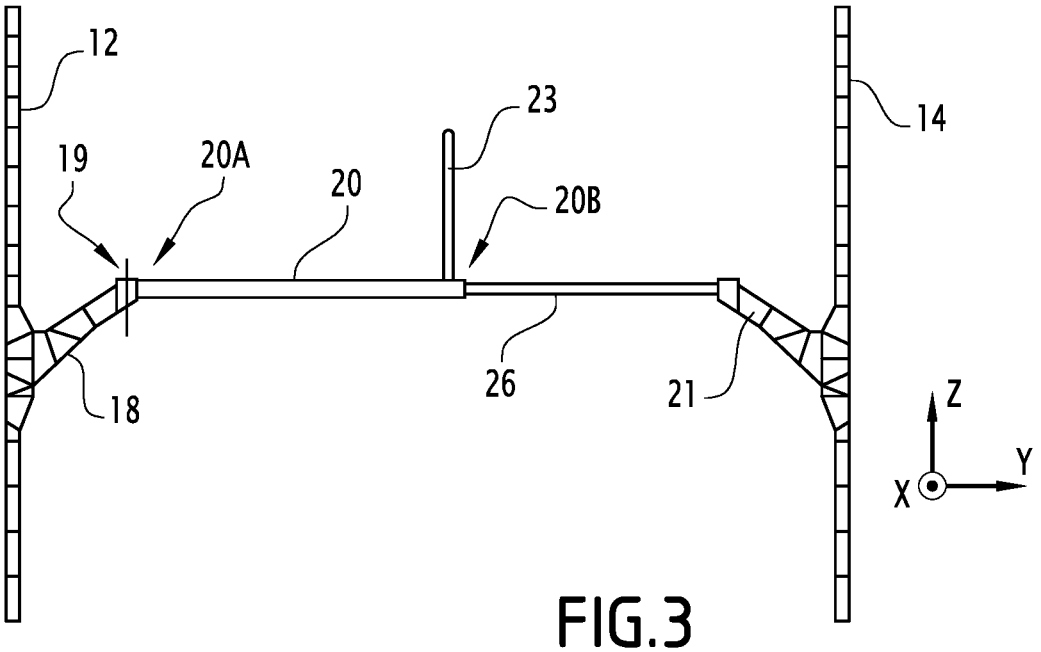
FIG. 3 is a view similar to FIG. 2 of a dining car according to a second exemplary embodiment of the invention.

In FIG. 3, the dining car 10 according to a second exemplary embodiment has been illustrated. In this figure, the elements similar to those of the previous figures are designated with identical references.

According to this second embodiment, the dining car 10 includes at least one horizontal cross-piece 26, connecting the second upper floor 20 to the second supporting portion 22. For example, each horizontal cross-piece 26 extends from the second edge 20B as far as this second supporting portion 22.

In the described example, the horizontal cross-pieces 26 are straight, but they may alternatively be arched, for esthetical reasons.

It will be noted that the first and second embodiments are compatible, so that the dining car 10 may include both uprights 24 and cross-pieces 26.

The invention is not limited to the embodiments described earlier, and may have diverse alternatives without departing from the scope of the claims.

The invention claimed is:

1. A dining car for a railway vehicle, including a first side face and a second side face laid out facing each other, and a first lower floor, the dining car comprising a first consumption area where passengers are placed for eating, a second preparation area which is a service area where onboard personnel prepare meals, and a third technical area which includes technical equipment for operating the dining car, the technical equipment comprising a cooling unit for preserving beverages and an electric supply unit, wherein:

the first side face includes first supporting portions extending from the first side face at a first height that support a second upper floor, the first, second and third areas are all on the first lower floor, and wherein the dining car includes the second upper floor, borne by the first supporting portions, wherein the second upper floor extends transversely between a first side edge of the second upper floor at a second height and a second side edge of the second upper floor, the second height being greater than the first height relative to the first lower floor, the first side edge extending from a distal portion of the supporting portions relative to the first side face, the second side edge being spaced apart from the second side face by a non-zero distance, so as to form a transverse aperture between the second side edge and the second side face, wherein the second upper floor forms a mezzanine extending above the first lower floor, so that the transverse aperture looks down on the first lower floor, and wherein a vertical longitudinal plane cutting the transverse aperture also cuts one of the first, second or third areas.

2. The dining car according to claim 1, further comprising an additional consumption area on the second upper floor.

3. The dining car according to claim 1, wherein the second upper floor is removably attached to the first supporting portions.

4. A dining car for a railway vehicle, including a first side face and a second side face laid out facing each other, and a first lower floor, the dining car comprising a first consumption area which is an area in which passengers are placed for eating, a second preparation area which is a service area in which onboard personnel prepare meals, and a third technical area which includes technical equipment for operating the dining car, wherein:

the first side face includes first supporting portions extending from the first side face at a first height for supporting a second upper floor, and the first, second and third areas are all on the first lower floor wherein the dining car includes the second upper floor, borne by the first supporting portions, wherein the second upper floor extends transversely between a first side edge of the second upper floor at a second height and a second side edge of the second upper floor, the second height being greater than the first height relative to the first lower floor, the first side edge extending from a distal portion of the supporting portions relative to the first side face, the second side edge being spaced apart from the second side face by a non-zero distance, so as to form a transverse aperture between the second side edge and the second side face, wherein the second upper floor forms a mezzanine extending above the first lower floor, so that the transverse aperture looks down on the first lower floor, and and a vertical longitudinal plane cutting the transverse aperture also cuts one of the first, second or third areas.

5. The dining car according to claim 4, further comprising a vertical upright, extending between the first lower floor and the second upper floor, in order to support this second upper floor.

6. The dining car according to claim 4, wherein the second side face includes second supporting portions, and the dining car includes horizontal cross-pieces, each connecting the second upper floor to the respective one of the second supporting portions.

7. The dining car according to claim 1, wherein the second upper floor is formed with a plurality of panels, for which at least one is assembled with at least one respective one of the first supporting portions.

8. The dining car according to claim 1, wherein the second upper floor is comprised of a composite material.

9. A railway vehicle, comprising at least one dining car, the dining car comprising:

a first side face and a second side face laid out facing each other, and a first lower floor, the dining car also comprising a first consumption area which is an area in which passengers are placed for eating, a second preparation area which is a service area in which onboard personnel prepare meals, and a third technical area which includes technical equipment for operating the dining car, the technical equipment comprising a cooling unit for preserving beverages and an electric supply unit, wherein:

the first side face includes first supporting portions extending from the first side face at a first height that support a second upper floor, and the first, second and third areas are all on the first lower floor, and wherein the dining car includes the second upper floor, borne by the first supporting portions, wherein the second upper floor extends transversely between a first side edge of the second upper floor at a second height and a second side edge of the second upper floor, the second height being greater than the first height relative to the first lower floor, the first side edge extending from a distal portion of the supporting portions relative to the first side face, the second side edge being spaced apart from the second side face by a non-zero distance, so as to form a transverse aperture between the second side edge and the second side face, wherein the second upper floor forms a mezzanine extending above the first lower floor, so that the transverse aperture looks down on the first lower floor, and wherein a vertical longitudinal plane cutting the transverse aperture also cuts one of the first, second or third areas.

* * * * *